US010600545B2

(12) United States Patent
Kim et al.

(10) Patent No.: US 10,600,545 B2
(45) Date of Patent: Mar. 24, 2020

(54) COIL ELECTRONIC COMPONENT AND METHOD OF MANUFACTURING THE COIL ELECTRONIC COMPONENT

(71) Applicant: SAMSUNG ELECTRO-MECHANICS CO., LTD., Suwon-si, Gyeonggi-do (KR)

(72) Inventors: Jin Seong Kim, Suwon-si (KR); Sung Sik Shin, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 63 days.

(21) Appl. No.: 15/725,708

(22) Filed: Oct. 5, 2017

(65) Prior Publication Data

US 2018/0268979 A1 Sep. 20, 2018

(30) Foreign Application Priority Data

Mar. 16, 2017 (KR) ..... 10-2017-0033179

(51) Int. Cl.

| | |
|---|---|
| ***H01F 27/24*** | (2006.01) |
| ***H01F 17/00*** | (2006.01) |
| ***H01F 17/04*** | (2006.01) |
| ***H01F 27/255*** | (2006.01) |
| ***H01F 41/04*** | (2006.01) |
| ***H01F 27/245*** | (2006.01) |
| *H01F 27/29* | (2006.01) |
| *H01F 27/28* | (2006.01) |

(52) U.S. Cl.

CPC ..... *H01F 17/0013* (2013.01); *H01F 17/04* (2013.01); *H01F 27/245* (2013.01); *H01F 27/255* (2013.01); *H01F 41/04* (2013.01); *H01F 41/046* (2013.01); *H01F 27/2823* (2013.01); *H01F 27/292* (2013.01)

(58) Field of Classification Search

CPC . H01F 3/08; H01F 3/10; H01F 27/255; H01F 27/245; H01F 27/2823; H01F 27/2804; H01F 2027/2809; H01F 41/04; H01F 41/046

USPC ..... 336/200, 223, 233

See application file for complete search history.

(56) References Cited

U.S. PATENT DOCUMENTS

| | | | | |
|---|---|---|---|---|
| 7,880,092 | B2 * | 2/2011 | Nishizawa | B32B 18/00 174/255 |
| 2007/0069844 | A1 * | 3/2007 | Kudo | H01F 17/0013 336/83 |
| 2010/0201473 | A1 * | 8/2010 | Konoue | H01F 17/0013 336/200 |
| 2010/0225437 | A1 * | 9/2010 | Ueda | H01F 17/0013 336/200 |
| 2018/0166199 | A1 * | 6/2018 | Hachiya | H01F 27/292 |

FOREIGN PATENT DOCUMENTS

| | | | |
|---|---|---|---|
| KR | 10-2015-0065434 | A | 6/2015 |
| KR | 10-1616610 | B1 | 4/2016 |

* cited by examiner

*Primary Examiner* — Mang Tin Bik Lian

(74) *Attorney, Agent, or Firm* — Morgan, Lewis & Bockius LLP

(57) ABSTRACT

A coil electronic component includes a base layer, a stacked structure of a plurality of coil patterns disposed on the base layer, and a buildup layer disposed between at least two coil patterns of the plurality of coil patterns, the buildup layer at least partially covering the coil patterns and having sintering properties different from those of the base layer.

7 Claims, 4 Drawing Sheets

COIL ELECTRONIC COMPONENT AND METHOD OF MANUFACTURING THE COIL ELECTRONIC COMPONENT

CROSS-REFERENCE TO RELATED APPLICATION

This application claims the benefit of priority to Korean Patent Application No. 10-2017-0033179, filed on Mar. 16, 2017 with the Korean Intellectual Property Office, the entirety of which is incorporated herein by reference.

TECHNICAL FIELD

The present disclosure relates electronic components and, in particular, to a coil electronic component and a method of manufacturing the same.

BACKGROUND

The present disclosure relates to a coil electronic component and a method of manufacturing the same.

A coil electronic component or an inductor is one of the components forming an electronic circuit, in addition to a resistor and a condenser, and is commonly formed as a coil wound or printed on a ferrite core with electrodes formed at both terminals, and is used as a component for removing noise, forming an LC resonant circuit, or the like. The inductor may be classified as one of various types, such as a stacked type, a wound type, a thin film type, and the like, according to a shape of a coil.

In the case of a multilayer inductor, a plurality of coil layers are stacked and then pressed to form the multilayer inductor. During pressing, deformation such as a lateral spread of coil patterns, or the like, may occur. When deformation occurring due to a factor such as pressing of a coil pattern, or the like, occurs, DC resistance characteristics and inductance characteristics of a multilayer inductor may be reduced. Such a reduction in characteristics may be further significant in a small inductor.

SUMMARY

An aspect of the present disclosure provides a coil electronic component having improved DC Resistance and inductance characteristics by significantly reducing a phenomenon in which a coil pattern spreads in a lateral direction. Another aspect of the present disclosure provides a method of effectively manufacturing the same using a buildup method.

According to an aspect of the present disclosure, a coil electronic component includes: a base layer; a stacked structure of a plurality of coil patterns disposed on the base layer; and a buildup layer disposed between adjacent coil patterns among the plurality of coil patterns to cover the coil patterns, and having sintering properties different from sintering properties of the base layer.

The base layer may have a sintered density higher than a sintered density of the buildup layer.

An interface between the base layer and the buildup layer may be coplanar with a bottom surface of a coil pattern disposed lowermost among the plurality of coil patterns.

The base layer and the buildup layer may include a ferrite element.

The base layer and the buildup layer may be formed of the same material.

The coil patterns may be provided with a filling rate measured based on a cross-sectional area of 80% or more.

The coil electronic component may further include a conductive via passing through the buildup layer while connecting the adjacent coil patterns among the plurality of coil patterns.

An outer shape of the coil electronic component may be rectangular, a length may be 6 mm or less, and a width may be 3 mm or less.

According to another aspect of the present disclosure, a method of manufacturing a coil electronic component includes: forming a coil pattern on a base layer; forming a buildup layer by applying a ceramic paste to cover the coil pattern on the base layer; and sintering the base layer, the coil pattern, and the buildup layer.

The buildup layer may be provided with viscosity higher than viscosity of the base layer.

The base layer may be a ceramic green sheet.

The base layer may be provided with a sintered density higher than a sintered density of the buildup layer, after the sintering.

The method of manufacturing a coil electronic component may further include forming an additional coil pattern on the buildup layer, and forming an additional buildup layer on the additional coil pattern.

A separate pressing process with respect to the base layer, the coil pattern, and the buildup layer may not be performed between the forming the buildup layer and the sintering.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
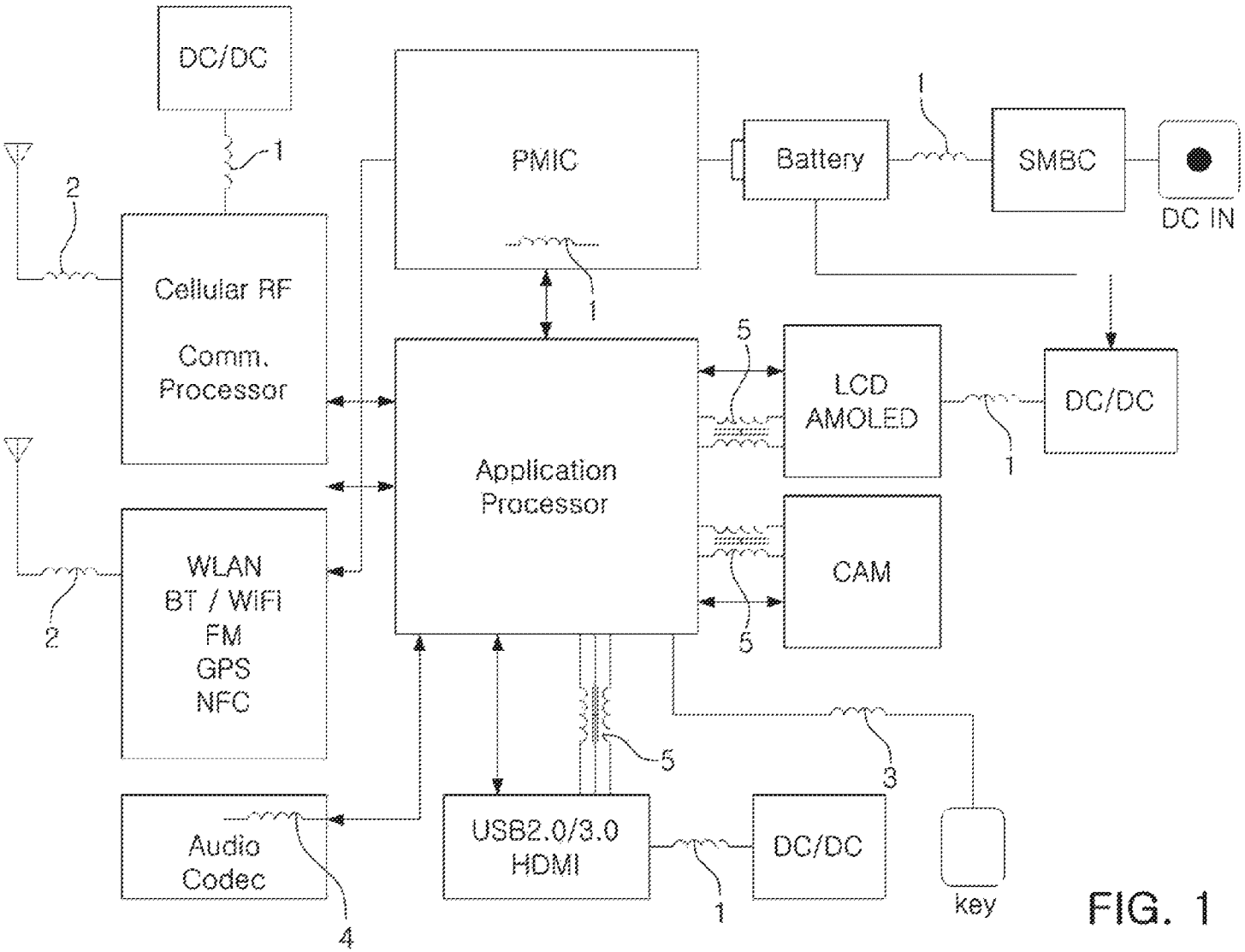
FIG. 1 schematically illustrates an example of a coil electronic component applied to an electronic device according to exemplary embodiments of the present disclosure.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being 'on,' 'connected to,' or 'coupled to' another element, it can be directly 'on,' 'connected to,' or 'coupled to' the other element or other elements intervening therebetween may be present. In contrast, when an element is referred to as being 'directly on,' 'directly connected to,' or 'directly coupled to' another element, there may be no other elements or layers intervening therebetween. Like numerals refer to like elements throughout. As used herein, the term 'and/or' includes any and all combinations of one or more of the associated listed items.

It will be apparent that although the terms first, second, third, etc. may be used herein to describe various members, components, regions, layers and/or sections, any such members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as 'above,' 'upper,' 'below,' and 'lower' and the like, may be used herein for ease of description to describe one element's relationship relative to another element(s) as shown in the figures. It will be understood that spatially relative terms are intended to encompass different orientations of the device in use or operation, in addition to the orientation depicted in the figures. For example, if the device in the figures is turned over, elements described as 'above,' or 'upper' relative to other elements would then be oriented 'below,' or 'lower' relative to the other elements or features. Thus, the term 'above' can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms 'a,' 'an,' and 'the' are intended to include the plural forms as well, unless the context clearly indicates otherwise. It will be further understood that the terms 'comprises,' and/or 'comprising' when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted alone, in combination or in partial combination.

The contents of the present disclosure described below may have a variety of configurations and propose only a required configuration herein, but are not limited thereto.

Electronic Device

FIG. 1 illustrates an example of a coil electronic component applied to an electronic device according to exemplary embodiments of the present disclosure.

Referring to FIG. 1, in an electronic device, various types of electronic components are used, for example, based on an application processor, a DC/DC converter, an originating communications processor (comm processor), a WLAN BT/WiFi FM GPS NFC unit, a power management integrated circuit (PMIC), a battery, a switch mode battery charger (SMBC), AMOLED, LCD, an audio codec, USB 2.0/3.0, HDMI, a CAM, and the like. In this case, between such an electronic component, various types of coil electronic components may be appropriately applied between these electronic components according to the use thereof in order to remove noise, and the like, for example, a power inductor 1, a HF inductor 2, a general bead 3, a GHz Bead 4, a common mode filter 5, and the like.

In detail, the power inductor 1 may be used to store electricity in the form of a magnetic field, to maintain an output voltage, to stabilize power, and the like. In addition, the HF Inductor 2 may be used to match impedances to secure a required frequency, to block a noise and an AC component, or the like. In addition, the general bead 3 may be used to remove noise of power and signal lines, to remove a high-frequency ripple, or the like. In addition, the GHz Bead 4 may be used to remove high frequency noise, related to an audio signal, or the like, from a signal line and a power line. In addition, the common mode filter 5 may be used to allow a current to pass in a differential mode, to remove only a common mode noise, or the like.

An electronic device may be a smartphone, but is not limited thereto. For example, the electronic device may be a personal digital assistant, a digital video camera, a digital still camera, a computer network, a computer, a monitor, a television, a video game, a smart watch, and the like, but an electronic device may be other various electronic devices well known to those skilled in the art.

Coil Electronic Component

Figure 2:
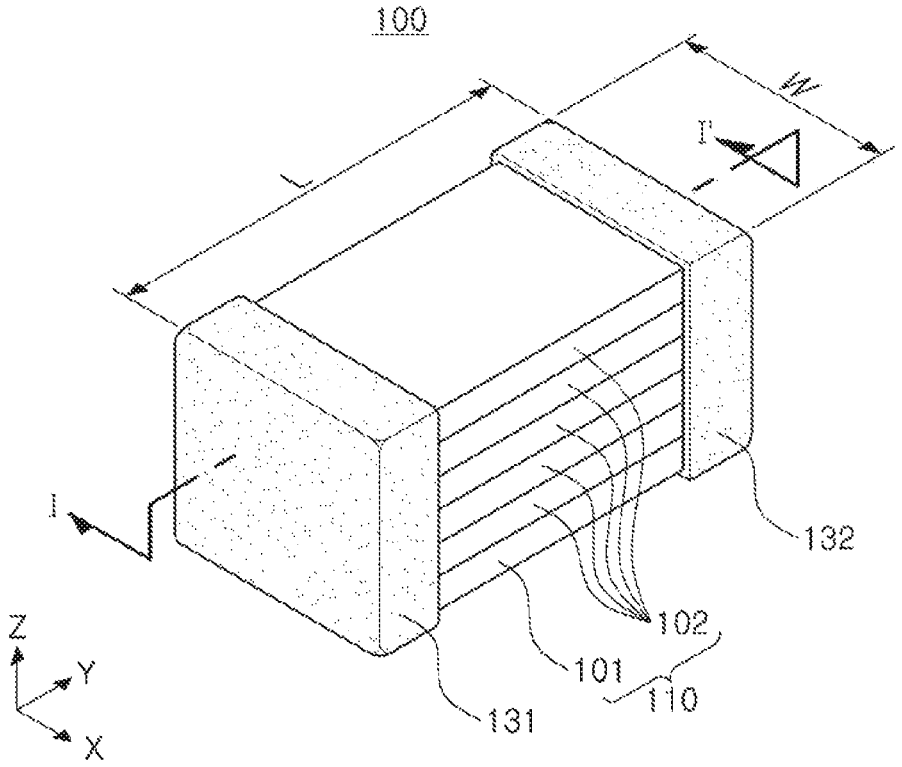
FIGS. 2 and 3 are a perspective view and a cross-sectional view taken along line I-I' of FIG. 2, respectively, illustrating a coil electronic component according to exemplary embodiments of the present disclosure.
Figure 3:
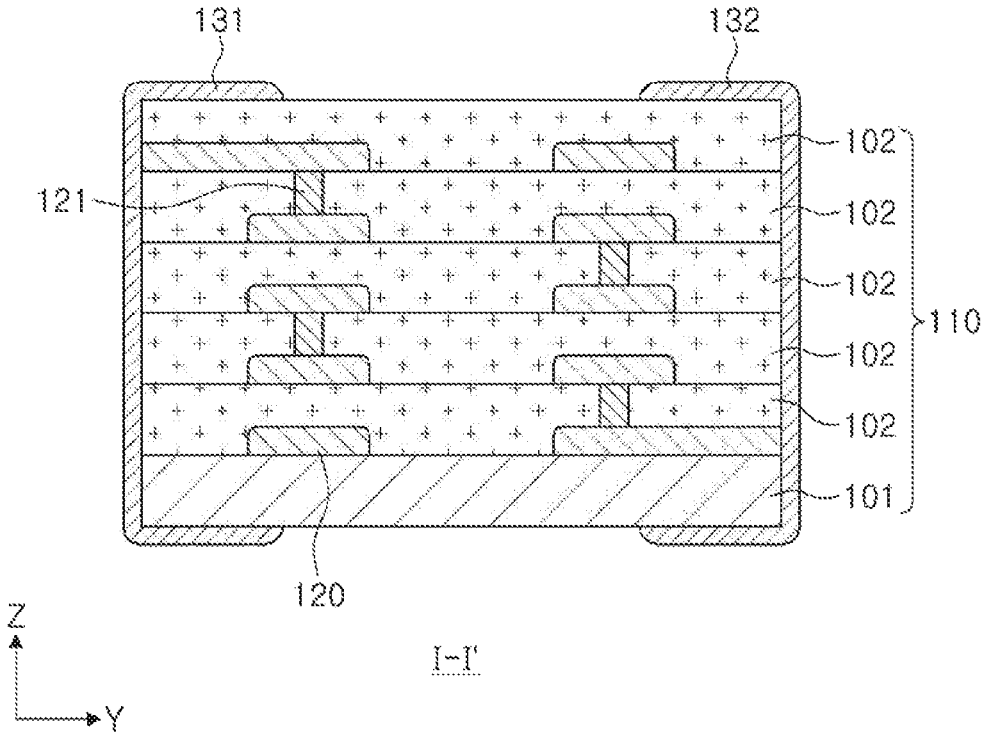

FIGS. 2 and 3 are a perspective view and a cross-sectional view taken along line I-I' of FIG. 2, respectively, illustrating a coil electronic component according to exemplary embodiments of the present disclosure.

Referring to FIGS. 2 and 3, a coil electronic component 100 may include a base layer 101, a stacked structure of a plurality of coil patterns 120, and a buildup layer 102, as a main component. In addition, a first external electrode 131 and a second external electrode 132 are provided to be electrically connected to a coil pattern 120. Hereinafter, components of the coil electronic component 100 will be described in detail.

The base layer 101 and the buildup layer 102 forma body 110. Thereamong, the base layer 101 and the buildup layer 102 may contain a magnetic material, in detail, a ferrite element. The ferrite element may be, for example, an $Al_2O_3$-based dielectric material, a Mn—Zn-based ferrite, a Ni—Zn-based ferrite, a Ni—Zn—Cu-based ferrite, a Mn—Mg-based ferrite, a Ba-based ferrite, a Li-based ferrite, and the like. In addition, as required, the base layer 101 and the buildup layer 102 include magnetic metal powder particles, and such a material may be a crystalline or amorphous metal containing one or more selected from the group consisting of iron (Fe), silicon (Si), boron (B), chrome (Cr), aluminum (Al), copper (Cu), niobium (Nb), and nickel (Ni), by way of example. An example of the material may be a Fe—Si—B—Cr-based amorphous metal. In addition, an oxide film is formed on surfaces of magnetic metal powder particles, so insulating properties of the metal magnetic body powder may be secured. Moreover, the base layer 101 and the buildup layer 102 are formed of the same material, but sintering properties may be different, as will be described later.

In an exemplary embodiment, a base layer 101 disposed lowermost in the body 110 has a higher sintered density than that of the buildup layer 102 disposed thereabove. In other words, even when the base layer 101 and the buildup layer 102 include substantially the same ferrite element, sintering properties of the base layer 101 are more excellent, so the base layer has a relatively dense sintered structure. Due to a difference between the sintering properties, an interface of regions in which sintered densities are different may be formed between the base layer 101 and the buildup layer 102. In this case, as illustrated in FIG. 3, an interface between the base layer 101 and the buildup layer 102 may be coplanar with a bottom surface of a coil pattern, disposed at a lowermost portion, of the plurality of coil patterns 120.

As described above, sintered densities of the base layer 101 and the buildup layer 102 are different. In this regard, because, as described later with respect to a manufacturing process, when the buildup layer 102 is provided using a build-up method in which a buildup layer in the form of paste is applied on the base layer 101 and the coil pattern 120, there is a difference in a sintered density with the base layer 101 in the form of a ceramic green sheet.

The coil pattern 120, as illustrated in FIG. 3, is stacked in a thickness direction to be electrically connected to other adjacent patterns, thereby forming a coil structure. The coil pattern 120 may be formed using a method in which a conductive paste is printed on a magnetic layer, or the like, and may be formed of a material containing, for example, silver (Ag), palladium (Pd), Al, Ni, titanium (Ti), gold (Au), Cu, platinum (Pt), or the like. In addition, a conductive via 121 may be included for an electrical connection of the plurality of coil patterns 120, and the conductive via 121 has a form connecting adjacent coil patterns among the plurality of coil patterns 120 and passing through the buildup layer 102. In this case, the conductive via 121 may be formed of the same material as the coil pattern 120.

In an exemplary embodiment, in the coil pattern 120, a filling rate, measured based on a cross-sectional area, may be 80% or more. Here, the filling rate based on a cross-sectional area is measured by cutting the coil pattern 120 in a direction illustrated in FIG. 3, and a value in which a maximum width is multiplied by a maximum thickness is regarded as an area of an ideal rectangular pattern. Thus, an area of an actual coil pattern 120 is calculated as compared to the area described above. When the filling rate of the coil pattern 120 is 80% or more, excellent DC resistance characteristics may be secured.

When the build-up process described above is used to provide the coil pattern 120 and the buildup layer 102, a high pressure is not applied to the coil pattern 120, so the occurrence of deformation such as lateral distortion of the coil pattern 120 may be significantly reduced. Thus, the coil pattern 120 may be provided to allow a cross section thereof to have a shape almost similar to a rectangle, and may further have a high level of an aspect ratio. As described above, the coil pattern 120 having a high filling rate and aspect ratio as unintended shape deformation is significantly reduced may have excellent DC resistance characteristics, and may sufficiently secure a core region (a central region formed by a coil pattern in FIG. 3), thereby improving inductance characteristics.

Meanwhile, an effect of improving a filling rate and an aspect ratio of the coil pattern 120 described above may be significant, when the coil electronic component 100 is relatively small. In detail, according to the research of the inventors, in the case of the coil electronic component 100 whose outer shape is a rectangular parallelepiped shape, when a length L is 6 mm or less and a width W is 3 mm or less, the effect of improving a filling rate and an aspect ratio of the coil pattern 120 may be significantly increased. According to the related art, when a small component is manufactured, a shape of a coil pattern is easily deformed, so it is limited in terms of effectively performing an intended function.

The first external electrode 131 and the second external electrode 132 are formed externally of the body 110 to be electrically connected to the coil pattern 120. As illustrated in FIG. 3, the first external electrode 131 may be connected to a coil pattern 120 at an uppermost portion and the second external electrode 132 may be connected to a coil pattern 120 at a lowermost portion. Each of the first external electrode 131 and the second the external electrode 132 may have a multilayer structure, for example, may include a first layer and a second layer. Here, the first layer may be provided as a sintered electrode obtained by sintering a conductive paste, and the second layer in the form covering the first layer may include at least one plating layer. Moreover, in addition to the first layer and the second layer, the first external electrode 131 and the second external electrode 132 may include further additional layers. For example, each of the first external electrode 131 and the second external electrode 132 may include a conductive resin electrode between the first layer and the second layer, thereby mitigating a mechanical impact, or the like.

Method of Manufacturing Coil Electronic Component

Hereinafter, referring to FIGS. 4 through 6, an example of a method of manufacturing the coil electronic component 100 having a structure described above will be described. The structural features of the coil electronic component 100 may be more clearly understood from the description of a manufacturing process which will be provided later.

Figure 4:
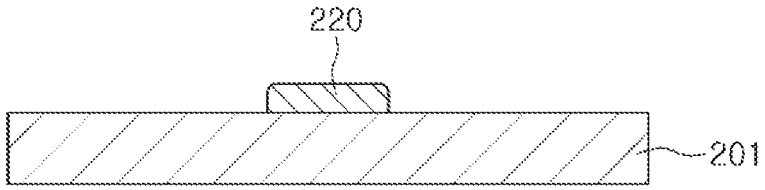
FIGS. 4 through 6 illustrate a method of manufacturing a coil electronic component according to exemplary embodiments of the present disclosure.

First, as illustrated in FIG. 4, a coil pattern 220 is formed on a base layer 201. The base layer 201 may be provided to have a form of a ceramic green sheet, in detail, a slurry form containing a ceramic particle, a binder, a solvent, or the like. The coil pattern 220 may be formed as a conductive particle, for example, a particle of Ag, Pd, Al, Ni, Ti, Au, Cu, Pt, or the like is provided in the form of a paste, and is then applied to the base layer 201, in the form of a coil.

Figure 5:
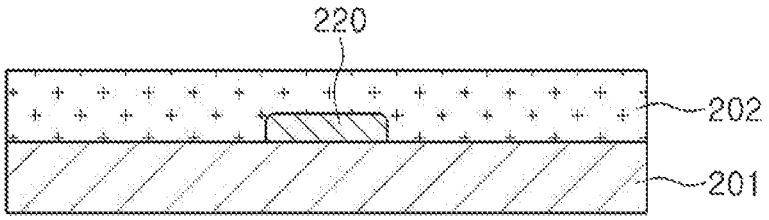

Thereafter, as illustrated in FIG. 5, a buildup layer 202 is formed on the base layer 201 to cover the coil pattern 220. The buildup layer 202 has the form of a ceramic paste, rather than a ceramic green sheet, in a different manner to the base layer 201. The buildup layer is applied to cover the coil pattern 220. As described above, the buildup layer 202 in the form of paste before sintering may have higher viscosity than that of the base layer 201 in the form of a ceramic green sheet, and the form of the buildup layer may be maintained on the base layer 201.

Figure 6:
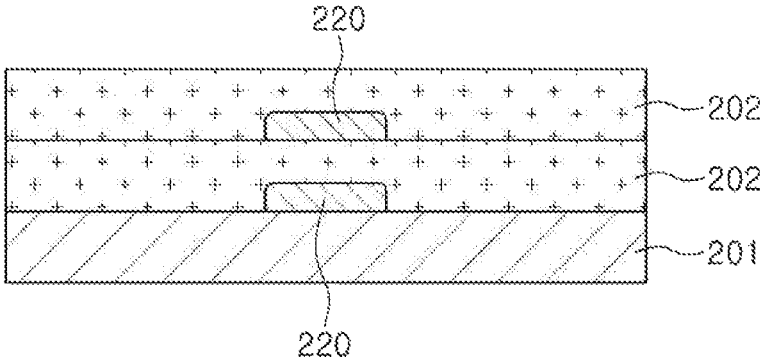

Thereafter, as illustrated in FIG. 6, an additional coil pattern 220 and an additional buildup layer 202 are formed on the buildup layer 202. As described previously, the coil pattern 220 is formed by applying a conductive paste, and the buildup layer 202 is formed by applying a ceramic paste. In this case, as the number of build-up processes are adjusted according to a shape of a desired coil, the number of the additional coil pattern, or patterns, 220 and the additional buildup layer, or layers, 202 may be determined.

After a build-up process described above, the base layer 201, the coil pattern 220, and the buildup layer 202 are sintered. In an exemplary embodiment, a sintering may be provided as a single sintering. After the sintering, a sintered density of the base layer 201 may be higher than that of the buildup layer 202. In this regard, the base layer 201, provided to have the form of a ceramic green sheet, is more easily densified than the buildup layer 202 in the form of paste.

Meanwhile, during the build-up process or a subsequent process, the buildup layer 202 may effectively protect the coil pattern 220. In other words, the buildup layer 202 is formed to be thicker than the coil pattern 220 and to cover the coil pattern, and thus protects the coil pattern 220. Thus, a deformation of the coil pattern 220 such as distortion may be reduced. In addition, as described above, the coil pattern 220 and the buildup layer 202 are formed in a method of being stacked on an upper portion of the base layer 201 using a build-up process, so a process of stacking in batches and pressing is not required. In other words, between forming the buildup layer 202 and sintering, a separate pressing process with respect to the base layer 201, the coil pattern 220, and the buildup layer 202 may not need to be performed. Compared to a process according to the related art, that is, a process in which a ceramic green sheet is manufactured in advance, and is then stacked in batches, and a stack is pressed, a possibility of deformation of the coil pattern 220 is significantly low, so the coil pattern 220 having a cross-section substantially similar to a rectangle may be provided.

As set forth above, according to exemplary embodiments, a coil electronic component is used, so inductance characteristic may be improved while DC resistance is effectively lowered. In addition, a build-up method is used, so such a coil electronic component may be effectively implemented.

While exemplary embodiments have been shown and described above, it will be apparent to those skilled in the art that modifications and variations could be made without departing from the scope of the present disclosure as defined by the appended claims.

What is claimed is:

1. A coil electronic component, comprising:

a body;

coil patterns stacked in a stacking direction and embedded in the body; and an external electrode disposed on a side surface of the body, connected to one of the coil patterns, and extending on upper and lower surfaces of the body in the stacking direction, wherein the body includes a base layer and buildup layers disposed on the base layer, the buildup layers cover the coil patterns, respectively, the lower surface is an exterior surface of the base layer, and the upper surface is an exterior surface of an uppermost one of the buildup layers, the buildup layers have sintering properties different from those of the base layer, the base layer has a sintered density higher than that of at least a portion of the buildup layers including portions disposed between the coil patterns and separating the coil patterns from each other in the stacking direction, and in a rectangle bounding a cross-section of each coil pattern and a respective buildup layer embedding the coil pattern, an area of conductive portions of each coil pattern of the coil patterns is at least 80% of an entire area of the rectangle bounding the cross-section of each coil pattern and the respective buildup layer embedding the coil pattern.

2. The coil electronic component of claim 1, wherein an interface between the base layer and one of the buildup layers is coplanar with a bottom surface of a lowermost one among the coil patterns.

3. The coil electronic component of claim 1, wherein the base layer and the buildup layers include a ferrite element.

4. The coil electronic component of claim 1, wherein the base layer and the buildup layers are formed of the same material.

5. The coil electronic component of claim 1, further comprising:

conductive vias passing through one or more of the buildup layers and connecting adjacent coil patterns among the coil patterns.

6. The coil electronic component of claim 1, wherein an outer shape of the coil electronic component is rectangular, a length is 6 mm or less, and a width is 3 mm or less.

7. The coil electronic component of claim 1, wherein a cross-section of each coil pattern of the plurality of coil patterns has a substantially rectangular shape.

* * * * *